US008915564B2

(12) United States Patent
Aumüller et al.

(10) Patent No.: US 8,915,564 B2
(45) Date of Patent: Dec. 23, 2014

(54) PRINTING PLASTIC FILMS USING A DIGITAL PRINTER COMPRISING STATIONARY PRINT HEADS FOR PRODUCTION ORDERS WITH SMALL LOT SIZES

(75) Inventors: Hans Jürgen Aumüller, Eich (DE); Heiko Usener, Bobenheim-Roxheim (DE); Lothar Held, Lampertheim (DE)

(73) Assignee: Renolit SE, Worms (DE)

( * ) Notice: Subject to any disclaimer, the term of this patent is extended or adjusted under 35 U.S.C. 154(b) by 35 days.

(21) Appl. No.: 13/390,987

(22) PCT Filed: Aug. 30, 2010

(86) PCT No.: PCT/EP2010/005313

§ 371 (c)(1),
(2), (4) Date: Mar. 29, 2012

(87) PCT Pub. No.: WO2011/029539

PCT Pub. Date: Mar. 17, 2011

(65) Prior Publication Data

US 2012/0176433 A1 Jul. 12, 2012

(30) Foreign Application Priority Data

Sep. 11, 2009 (DE) ..... 10 2009 040 937

(51) Int. Cl.
*B41J 2/205* (2006.01)
*B41J 3/407* (2006.01)
*B41J 2/21* (2006.01)

(52) U.S. Cl.
CPC ..... *B41J 2/2128* (2013.01); *B41J 3/4073* (2013.01)
USPC ..... 347/15

(58) Field of Classification Search
CPC ..... B41J 2/2128; B41J 3/4073
USPC ..... 347/15, 42, 232, 102, 106; 399/29; 523/160; 101/483
See application file for complete search history.

(56) References Cited

U.S. PATENT DOCUMENTS 5,748,221 A * 5/1998 Castelli et al. ..... 347/232
5,878,664 A 3/1999 Hartka (Continued)

FOREIGN PATENT DOCUMENTS

DE 10 2006 022 774 B3 11/2007
DE 10 2007 049 784 A1 4/2009

(Continued)

OTHER PUBLICATIONS

A. Tribute: Digital Colour Printing on the Way to Offset Quality, ACTA Graph. 16(2004)1, 15-18; www.actagraphica.hr/index.php/actagraphica/article/download/61/48.*

(Continued)

*Primary Examiner* — Alessandro Amari
*Assistant Examiner* — Carlos A Martinez
(74) *Attorney, Agent, or Firm* — Paul D. Strain, Esq.; Strain & Strain PLLC

(57) ABSTRACT

A method for producing small lots of printed plastic film is described, wherein in terms of the resolution and colors the print corresponds to the print generated by means of the intaglio printing method. The film (1) is printed by way of an array of print heads (2*a*, 2*b*) with an ink using the ink jet printing method, said ink containing the same dyes and/or pigments, and the property of the ink is adapted to the ink jet printing method.

15 Claims, 2 Drawing Sheets

(56) References Cited

U.S. PATENT DOCUMENTS

| | | | | |
|---|---|---|---|---|
| 6,027,203 | A * | 2/2000 | Campbell | 347/42 |
| 6,047,143 | A * | 4/2000 | Larson et al. | 399/29 |
| 2002/0068772 | A1 * | 6/2002 | Laksin et al. | 523/160 |
| 2003/0128264 | A1 * | 7/2003 | Ishikawa et al. | 347/102 |
| 2006/0075917 | A1 * | 4/2006 | Edwards | 101/483 |
| 2007/0266877 | A1 | 11/2007 | Oldorff | |
| 2007/0296795 | A1 * | 12/2007 | Frati | 347/106 |
| 2010/0231631 | A1 * | 9/2010 | Hosaka | 347/15 |

FOREIGN PATENT DOCUMENTS

| | | | |
|---|---|---|---|
| DE | WO2011029539 | * | 3/2011 |
| EP | 1 145 863 | A1 | 10/2001 |
| EP | 1 628 467 | A1 | 2/2006 |
| UA | 43184 | A | 11/2001 |
| WO | WO 01/19618 | A1 | 3/2001 |

OTHER PUBLICATIONS

German Examination Report, DE 10 2009 040 937.8, Apr. 28, 2010, 4 pgs.

"Inkjet für (fast) jeden", Produkte & Konzepte, Material + Technik Möbel (Mar. 2009), p. 13.

International Search Report, PCT/EP2010/005313, Nov. 23, 2010, 3 pgs.

Ukranian Notice of Allowance, Appl. No. 201204544, Aug. 13, 2014, 3 pgs.

* cited by examiner

PRINTING PLASTIC FILMS USING A DIGITAL PRINTER COMPRISING STATIONARY PRINT HEADS FOR PRODUCTION ORDERS WITH SMALL LOT SIZES

CROSS-REFERENCE TO RELATED PATENT APPLICATIONS

This application is a National Stage of International Application No. PCT/EP2010/005313, filed Aug. 30, 2010, which is based upon and claims the benefit of priority from prior German Patent Application No. 10 2009 040 937.8, filed Sep. 11, 2009, the entire contents of all of which are incorporated herein by reference in their entirety.

The present invention relates to a method for printing plastic films for production orders with small lot sizes.

Printed plastic films for finishing surfaces are widely common. The fields of application include primarily the furniture industry as well as the construction sector, in which the imitation of wooden surfaces is particularly in demand. The widespread success of faux wood decor is meanwhile less due to cost reasons and more due to considerably improved usage characteristics. Furniture as well as windows, doors and similar components having a plastic surface, for example, are easier to care for, less sensitive and more durable than the wooden models. The quality of printed faux wood grain is so high that often times they are difficult to visually distinguish from "real" wood, even up close.

This high quality of the print has so far only been achieved by the direct rotogravure method. The disadvantage is that the production of the print rollers is complex and expensive. In addition to the high resolution, another decisive factor is the solvent-based printing inks using with this method, which enable the high resolution and good adhesion when using plastic films as the substrates. Given the high costs of the print rollers, the production of small-batch series, for example of several hundred or thousand meters, is not economically possible. The production of proof copies is also economically not profitable because during start-up of the printing process generally several hundred linear meters of scrap are generated. Because of the technology, standard lot sizes therefore always comprise more film (raw material) than can be sold to the customers.

It would be desirable to have a printing method by which these problems can be better solved. While digital printing methods are known, which in principle would lend themselves for this purpose, with respect to plastic films these methods lack the necessary resolution and/or speeds and a suitable printing ink to be employed economically. During color matching, additionally the printing inks for digital print have entirely different fundamentals and chromophore substances, so that it is practically never possible to produce a true color match. The colors and the decor are not identical to those found later in rotogravure printing (for example, metamerism), which is used for producing the customary quantities of several thousand meters of film and more.

In order to produce color matches for laminates in which the decor is printed on paper using the indirect rotogravure method, DE 10 2006 022 774 B3 proposes the use of an identical ink in an ink jet printing method. This cannot be applied to films, in particular for small-batch series. Moreover, the finishing step is implemented discontinuously by means of a short-cycle press in conjunction with a synthetic resin layer, which corresponds to a cross-linking thermoset material. The inks used in ink jet printing do not exhibit the resistance to atmospheric conditions required for use, are typically based on water and consequently do not provide the adhesion and drying required for plastic films. Surprisingly, experiments have shown that the print was not smudge-proof, and it was therefore not possible to further process the printed film, even several days after printing. The attempt to use solvent-based dyes that are used in the direct rotogravure printing of films as inks has failed.

It has also been shown that UV-cross-linking printing inks (thermoset materials) cannot be used because in order to protect the print, printed film qualities (thermoplastics) are generally thermally laminated non-detachably to a transparent thermoplastic film in a continuous process and embossed. During use, the transparent film would easily detach from the printed film under the slightest outside influence. The printing ink therefore must also exhibit thermoplastic behavior.

Another object was therefore to find an option of economically producing small-batch series of up to a thousand meters of film length in the quality known from rotogravure printing.

Surprisingly, it has now been found that it is possible to achieve a sufficient print speed using what are known as single-pass print heads, wherein the ink used for rotogravure can be applied with the necessary resolution after modifying the viscosity, binding agent, solvent, pigments and a finer dispersion thereof.

The use of fixed print heads with a corresponding moving print substrate is in principle known from the plotter. However, previously there was no option to print the required widths of 1 to 2 meters at an acceptable speed. Even when producing small-batch series, the film width must correspond to the one used customarily in the range of 1.50 to 2.00 meters to be able to operate economically. This was possible neither with plotters nor with the ink jet printers developed therefrom, the maximum width that was implemented merely amounted up to 50 cm.

According to the invention, arrays of stationary print heads are used, which allow the necessary width of 1.50 meters to 2.00 meters by arranging individual print heads next to each other and arranging at least two rows of print heads behind each other for each ink. The print heads comprise corresponding fixed nozzles for the dyes, which apply, in the manner known, preferably in a piezoelectrically controlled manner, the necessary amount of ink to the film which is passed underneath. Because of the offset arrangement of the print heads, the entire surface can be printed. In particular so-called "drop on demand" systems are suitable.

The ink contains essentially the same dyes and/or pigments as the ink used in the rotogravure method. However, the viscosity and properties of the ink must be adjusted for the application in the ink jet printing method. For this purpose, for example, the type and concentration of solvents are modified, or the concentration of stabilizers is reduced or they are omitted. The binding agent can also be adjusted, however care must be taken that properties such as light and UV stability are maintained, and the color effect of the dyes/pigments also must not be changed. Moreover, it may be necessary to adapt the fineness of the pigments, because the nozzles of the print heads are frequently not compatible with the pigment sizes used in rotogravure. Because of the finer grinding of the pigments, the quantities thereof may need to be adjusted. Otherwise, especially in the case of color matching, the application quantities of the pigments/dyes should not deviate from the quantities in the later production process.

Surprisingly, the speed of the printing process that was reached with these measures was 20 m/min to 40 m/min, which allows an economical production of small-batch series.

As far as the resolution is concerned, the quality of the print corresponds to that of the rotogravure method because when using the adjusted inks and the print head arrays the ink can be applied to the plastic film with the same precision as in rotogravure. It is important in particular that the ink is solvent-based, as is the case with rotogravure inks.

According to the invention, it is further advantageous if a colorimeter monitors the ink and print consistency.

The identity between rotogravure print and digital print is also achieved according to the invention by setting the controllers of the print heads such that the application of ink is controlled locally and in terms of quantity in accordance with the rotogravure method. In contrast to regular controllers, not only the decor is taken into consideration, but also the local quantity distribution of the ink is simulated, as occurring with rotogravure.

This allows for identity of the decor to be achieved between digital print and rotogravure, no or only minimal metamerism occurs, and it is possible to print arbitrary decors, such as faux wood, fantasy patterns or single colors, both for color matching and as small-batch series.

It is particularly advantageous that it is possible to use not only digital data to produce a print roller but also, for example, printed films, veneers or other arbitrary surfaces to generate the digital data, for example by means of scanner.

The invention will be described based on the figure, however without being limited to the embodiment that is specifically described.

Figure 1:
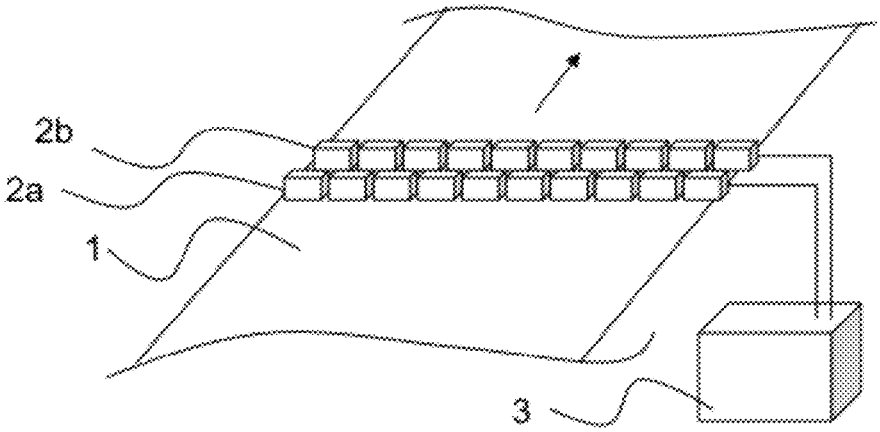
FIG. 1 schematically illustrates the method according to the invention.

The film 1 is passed in a manner known per se under an array of print heads, which here is indicated by two rows of print heads 2*a* and 2*b*. In general, four to eight rows of print heads are useful. The film is typically rolled off a reel and fed to the print head array via suitable guide rollers. The running direction of the film is indicated by an arrow. For the sake of clarity, only a portion of the film is shown and the feed devices, which are known per se, have been omitted. Depending on the desired print pattern, the print heads 2*a* and 2*b* are actuated by the controller 3 such that the corresponding quantity of ink is sprayed onto the film being passed by. This controller is known per se and allows the desired print pattern to be digitally predefined and applied right from the first centimeter without any start-up quantity of film. The feeding of ink to the print heads is not shown. Depending on the length, the film is then wound onto a reel or cut directly to the desired size of the color match.

It is thus possible according to the invention to produce a quantity of a few meters, for example 1 to 2 m, for color matches. Given the high speed of the printing method, it is possible to economically produce a small-batch series of several hundred to several thousand meters. This is of particular interest for non-standard colors or decors, which previously were not possible to implement with acceptable expense. Designers and architects thus now have entirely new individuality at their disposal. However, also during manufacturing it is possible even better to produce the parts decorated with the film to order. Providers of furniture or windows and similar elements for the outside are no longer required to purchase large quantities of film and consequently store them if the standard film reel has not been used up for the order that was received.

It is possible much more easily to provide samples for even very individual design requests and then produce the necessary small batch of film. Thanks to the digital printing method, the individual design can be stored and retrieved at any time as needed. This represents a major advantage because it is possible, for example, to repurchase furniture even after years. It is also possible without difficult to supply the matching decor for necessary repairs on windows, doors and the like or for the subsequent installation of additional windows.

The invention also relates to all possible combinations of preferred embodiments, provided they do not mutually exclude each other. The expressions "approximately" or "about" in conjunction with numerical data shall mean that values that are higher or lower by at least 10%, or values that are higher or lower by 5%, and in any case values that are higher or lower by 1%, shall be included.

COMPARATIVE EXAMPLE 1

Digital Printing in a Single-pass Method Using Water-based Printing Inks on PVC Films At a printing machine manufacturer, printing tests were carried out on a production system using different PVC films from Renolit AG. The system was built to print paper using aqueous printing inks.

Machine data:
Print width: max. 200 mm
Print heads: Xaar 760 (Top shooter)
Print speed: max. 25 m/min
Drying unit: IR radiator In the first test, paper was the standard substrate material to be printed, which was printed and dried without difficulty. Subsequently, a semi-hard transparent film made of PVC having a thickness of 100 μm was printed. While it was possible to print the film, it was not possible to dry the printing ink and some of the ink deposited on the pressure roller. Thereupon, the radiator output of the IR radiator was increased. This showed no improvement. The output of the radiators could be increased only to a limited extent because the film became undulated, grazed the print heads and thus damaged the print. Reducing the speed to approximately 8 m/min also showed no improvement. After a machine shutdown, a film sample was removed between the outfeed of the print unit and the pressure roller and set aside. When the surface was touched, it was possible to wipe off the print—even after an extended storage period of one week. The same behavior was exhibited by a hard, colored PVC film having a thickness of 100 μm. A printing ink system using water-based inks that is matched to paper is therefore not suitable for PVC films.

Figure 2:
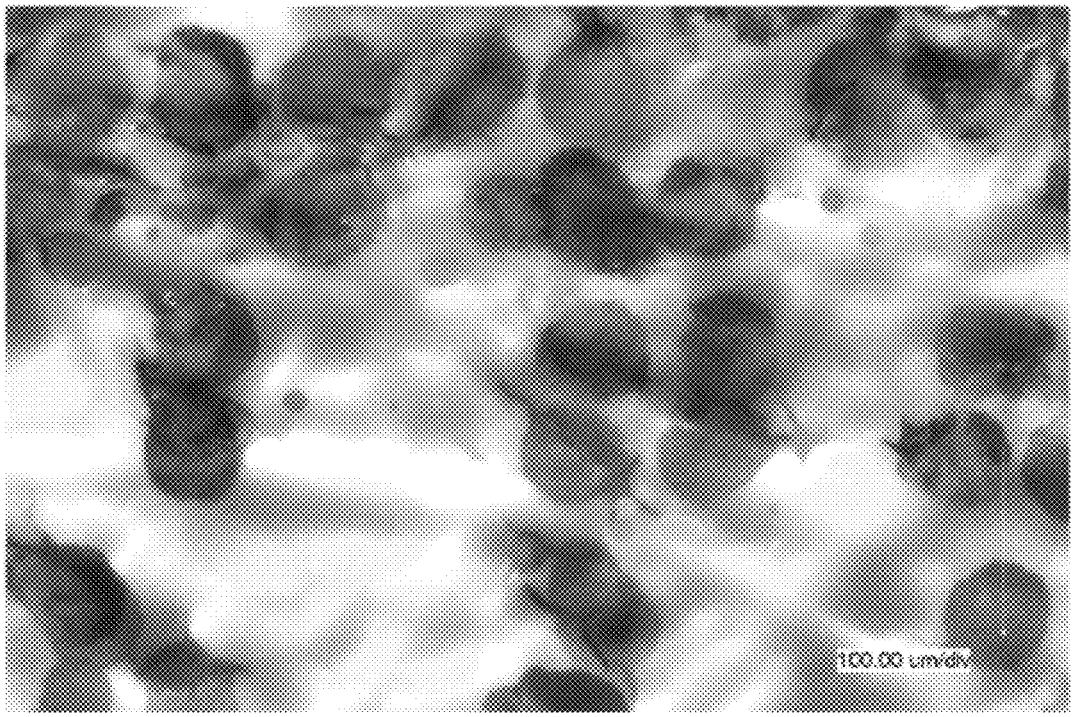
FIG. 2 microscope image with paper where the dots are almost round.
Figure 3:
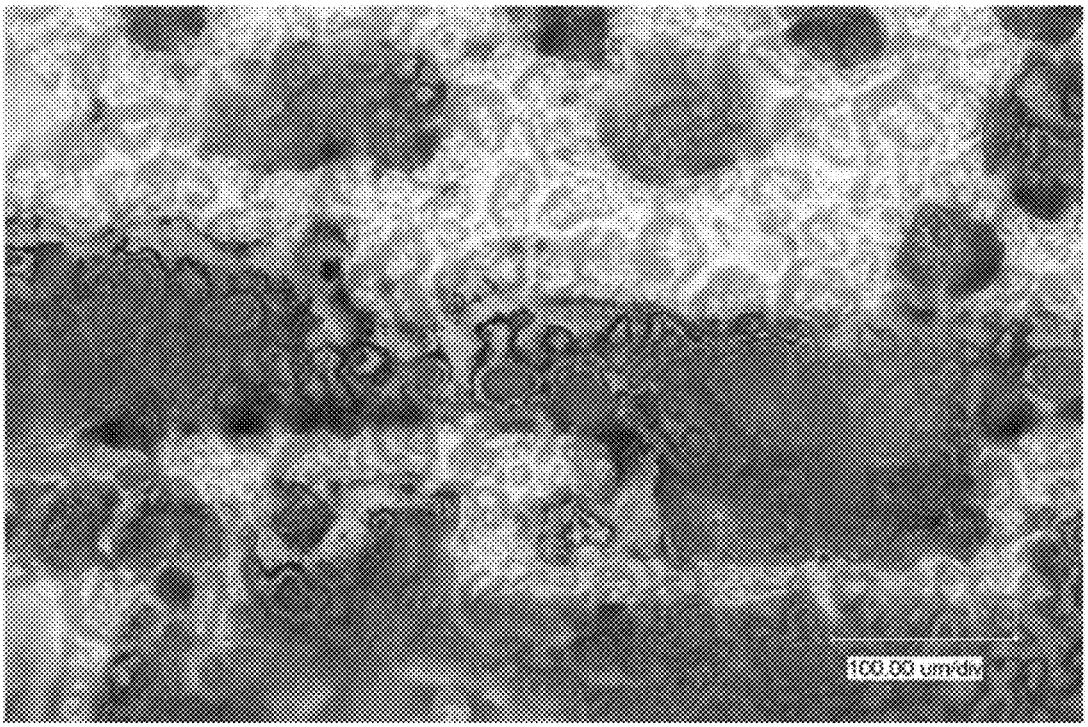
FIG. 3 microscopic image with the PVC film where the drops run when they are printed on top of each other for color mixing.

Microscope images show this even better. As is shown in FIG. 2, with paper the dots are almost round. In contrast, with the PVC film the drops run when they are printed on top of each other for color mixing, see FIG. 3.

LIST OF REFERENCE NUMERALS

1 Film
2*a* Print Heads
2*b* Print Heads
3 Controller

The invention claimed is:

1. A method for producing color matches or small-batch series of printed plastic film, in which the print is identical to the print produced by the rotogravure method in terms of resolution and colors, wherein the film is printed by an array of stationary print heads in an ink jet method using an ink that contains the same dyes and/or pigments, wherein the viscosity and the properties of the ink are adjusted to the ink jet printing method, and a controller controls the application of the ink locally and in terms of quantity such that a rotogravure application is simulated.

2. The method according to claim 1, wherein the viscosity of the ink is in the range of <15mPa·s.

3. The method according to claim 1, wherein the fineness of the pigments is adjusted to the ink jet printing method and resulting color deviations are compensated for by varying the quantities.

4. The method according to claim 1, wherein between 1 m and 3000 m of film are printed.

5. The method according to claim 1, wherein a colorimeter is used to monitor color and print consistency.

6. The method according to claim 1, wherein a pattern for ink jet printing is obtained by scanning an existing printed film, veneers and other arbitrary surfaces.

7. The method according to claim 1, wherein a rotogravure cylinder is produced in accordance with the data for the ink jet printing process.

8. A method for producing color matches or small-batch series of printed plastic film, wherein the resolution and color quality of said color matches or small-batch series of printed plastic film is identical to or exceeds that of a print produced by a rotogravure printing machine, comprising the following steps:

providing a plastic film, providing an array of stationary ink jet print heads, providing a controller, providing an ink by adjusting the viscosity, binding agent, solvent, fineness and/or quantity of pigments, and/or dispersion of a rotogravure ink for an ink jet printing process, and printing onto the plastic film a pattern defined by the ink using the array of stationary ink jet print heads, wherein the application of ink at each ink jet print head during printing is controlled by the controller.

9. A method for producing color matches or small-batch series of printed plastic film, in which the print is identical to the print produced by the rotogravure method in terms of resolution and colors, wherein the film is printed by an array of stationary print heads in an ink jet method using a solvent based ink that contains the same dyes and/or pigments, wherein the viscosity and the properties of the ink are adjusted to the ink jet printing method, and a controller controls the application of the ink locally and in terms of quantity such that a rotogravure application is simulated.

10. The method according to claim 9, wherein the viscosity of the ink is in the range of <15mPa·s.

11. The method according to claim 9, wherein the fineness of the pigments is adjusted to the ink jet printing method and resulting color deviations are compensated for by varying the quantities.

12. The method according to claim 9, wherein between 1 m and 3000 m of film are printed.

13. The method according to claim 9, wherein a colorimeter is used to monitor color and print consistency.

14. The method according to claim 9, wherein a pattern for ink jet printing is obtained by scanning an existing printed film, veneers and other arbitrary surfaces.

15. The method according to claim 9, wherein a rotogravure cylinder is produced in accordance with the data for the ink jet printing process.

* * * * *